US007520974B2

(12) United States Patent
Whitmore

(10) Patent No.: US 7,520,974 B2
(45) Date of Patent: Apr. 21, 2009

(54) CATHODIC PROTECTION OF A CONCRETE STRUCTURE HAVING A PART IN CONTACT WITH A WETTING MEDIUM AND A PART ABOVE THE MEDIUM

(76) Inventor: David Whitmore, 38 King Drive, Winnipeg, Manitoba (CA) R3T 3E5

( * ) Notice: Subject to any disclaimer, the term of this patent is extended or adjusted under 35 U.S.C. 154(b) by 207 days.

(21) Appl. No.: 11/678,932

(22) Filed: Feb. 26, 2007

(65) Prior Publication Data

US 2008/0202941 A1 Aug. 28, 2008

(51) Int. Cl.
*C23F 13/06* (2006.01)

(52) U.S. Cl. ..... 205/734

(58) Field of Classification Search ..... 205/734; 204/196.37

See application file for complete search history.

(56) References Cited

U.S. PATENT DOCUMENTS 4,692,066 A 9/1987 Clear
4,812,212 A * 3/1989 Dimond et al. ..... 205/734
5,714,045 A 2/1998 Lasa et al.
6,346,188 B1 * 2/2002 Shuster et al. ..... 205/734
6,358,397 B1 * 3/2002 Lyublinski ..... 205/734

* cited by examiner

*Primary Examiner*—Bruce F Bell
(74) *Attorney, Agent, or Firm*—Adrian D. Battison; Ade & Company Inc.

(57) ABSTRACT

Corrosion of steel in a concrete structure such as a column in sea water occurs primarily at the zone which is subject to a wetting and drying action and is inhibited using cathodic protection by attaching to the column at the zone an impervious sealed sleeve which carries no anode itself but which cooperates with an anode body in the water. The sleeve acts to inhibit permeation of oxygen through the concrete to the steel and at the same time acts to promote transfer of current from the anode through the concrete under the sleeve by preventing drying by preventing moisture escape. An anode arrangement may be provided only at the top of the sleeve to consume oxygen in that area. The sleeve may be applied over a layer of grout. The top edge surface of the grout may be sealed from the sleeve to the column.

28 Claims, 5 Drawing Sheets

CATHODIC PROTECTION OF A CONCRETE STRUCTURE HAVING A PART IN CONTACT WITH A WETTING MEDIUM AND A PART ABOVE THE MEDIUM

This invention relates to a method of cathodic protection of a concrete structure having a part in contact with a wetting medium and a part above the medium, such as a column within a salt water environment.

BACKGROUND OF THE INVENTION

Concrete structures such as columns in salt water tend to corrode at the location just above the salt water in the intertidal and splash zones where the column is subject to wetting and drying.

One solution to this problem is to surround the column with a jacket containing a layer of grout within which is buried or located a sacrificial anode as a mesh or layer surrounding the column. This anode is electrically connected to the steel in the column to set up an electric current through the connection and an ionic current through the electrolyte and the concrete from the anode to the steel to tend to inhibit the corrosion of steel in favour of the corrosion of the sacrificial anode.

An example of an arrangement of this type is shown in U.S. Pat. No. 5,714,045 (Lasa) assigned to Alltrista Corporation and issued. Another example is shown in published PCT Application WO 2005/035831 of the present applicant published 21 Apr. 2005. Yet another example is shown in U.S. Pat. No. 4,692,066 (Clear) issued Sep. 8, 1987. The disclosures of each of the above three documents is incorporated herein by reference.

It is also known to simply clamp an anode onto the column below water level to protect the portion of the column within the water. As the salt water is highly conductive, most of the current generated is transferred to steel in the wet portion of the column and little of the current generated in the galvanic action is transferred to the area of most corrosion which is the area at and above the water line which is wetted and dried. This problem is discussed in the above patent of Clear.

In some cases, as shown for example in Lasa above, the above jacket and anode arrangement is used with a below water additional anode, commonly known as a bulk anode, so as to avoid the lower part of the mesh anode in the jacket which is mostly or wholly below water from being rapidly corroded and lost.

In other cases, for a simple inexpensive repair with no cathodic protection, a simple wrapping is applied around the column at the water line so as to cover up and hide the worst of the damage. This arrangement may provide a physical barrier but of course does not provide any cathodic protection by galvanic action so that the underlying corrosion continues. As discussed in Lasa above, this type of repair is considered to be merely cosmetic, merely acting to cover up the worst of the cracking and exposed steel. However this can provide a cheap fix with short life span of protection. The wrapping can surround a layer of grout which covers the worst of the cracking and repairs any holes or the wrapping can be applied directly to the column. In some cases the wrapping is filled with a non-cementitious material such as epoxy.

SUMMARY OF THE INVENTION

It is one object of the invention to provide an alternative method for cathodic protection of a concrete structure which may allow a less expensive and/or simpler application which can use locally and non-specifically manufactured parts while providing an effective cathodic protection of the steel.

According to one aspect of the invention there is provided a method of cathodic protection of a concrete structure comprising:

wherein a first part of the concrete structure is in contact with a medium, which contains water and is ionically conductive, and a second part of the concrete structure, continuous with the first part, is spaced from the medium and exposed to air;

the concrete structure having steel reinforcement in the first part and the second part;

applying to the structure a covering layer which covers at least part of at least one surface of the structure, the layer extending from the first part of the structure to the second part of the structure so as to have a portion of the layer which is generally in contact with the moisture and a portion of the layer which is generally out of contact with the moisture;

inhibiting passage of oxygen from the air to the concrete covered by the layer by forming the layer from an oxygen impermeable material and by attaching the layer such that the layer is sealed relative to the concrete;

inhibiting passage of moisture to the air from the concrete covered by the layer by forming the layer from a moisture impermeable material and by attaching the layer such that the layer is sealed relative to the concrete, such that the concrete in the second part of the structure covered by the layer is maintained wetted by the moisture;

providing an anode in the medium;

providing an electrical connection from the anode in the medium to the steel in the concrete;

arranging the anode such that a current flows through the electrical connection between the anode and the steel and an ionic current flows through the medium and the concrete between the anode and the steel tending to inhibit corrosion of the steel;

the anode being arranged such that no part of the anode is located under that part of the layer which is generally within the medium and no part of the anode is located under at least a portion of the layer extending from the medium which is generally out of the medium into the second part of the structure;

and inhibiting corrosion in the steel in the second part of the structure lying under the layer by the anode in the medium.

Preferably the method includes inhibiting corrosion in the steel in the second part of the structure lying under the layer by current passing through the concrete under the layer which is maintained wetted by the layer.

Preferably the method includes inhibiting corrosion in the steel in the second part of the structure lying under the layer by a reduction in the level of oxygen in the concrete under the layer.

The layer can be applied directly on the surface of the concrete or may have a grout layer on the inside. The grout layer can be formed using the layer as a form or the layer may be applied after the grout is formed and set The layer can be a simple coating such as a paint layer.

The layer may be a stretchable plastic wrap

In one preferred arrangement, the covering layer contains reinforcing fibers or other reinforcing materials.

In this arrangement, the covering layer may cooperate with the steel reinforcement to provide structural strength for the concrete.

Alternatively the covering layer may be resilient so as to move with the concrete. In this way the layer may be stretchable to move as cracks for so as to bridge the cracks.

The grout may include a corrosion inhibitor of the type disclosed in U.S. Pat. No. 6,793,800 of the present inventor, the disclosure of which is incorporated herein by reference.

The present inventor has realized therefore that an effective level of cathodic protection against corrosion can be achieved in the area of the wetting/drying zone of the structure by the combined effect of firstly carrying the ionic current more effectively up inside the impervious covering layer by maintaining the concrete wetted in this area and secondly by excluding oxygen from this area to lower the level of current which is required Without reliance on a particular theory, it is believed that the corrosion at the inter-tidal and splash zones caused by repeated wetting and drying generates suitable conditions for rapid corrosion of the steel in this section of the column. This section has access to oxygen during the time when not immersed in the salt water and has access to the chlorides in the conductive medium of the salt water which causes corrosion of the steel. Thus the part of the column which is continually submerged has less corrosion because the water inhibits availability of oxygen and that part of the column which is continually dry has little corrosion because the concrete is not heavily contaminated with chlorides and is not exposed to wet conditions.

The present inventor based on his extensive knowledge in this field has found that the relatively expensive mesh anode conventionally used in such jacket systems can be omitted and yet a level of protection can be obtained which is satisfactory in many installations by the above techniques.

The omission of the mesh anode provides a significant cost saving. However the effect is not achieved simply by omitting the anode but also it is necessary to ensure that the surrounding impervious layer is both properly impervious and properly sealed to substantially exclude the penetration of oxygen and to substantially prevent the escape of water which would otherwise allow drying of the column which restricts the ionic current flow.

In most cases the whole of the layer is arranged such that no part of the anode is located under the layer. That is the whole of the layer contains no anode material and nothing contributing to the current flow.

However in some cases the layer is free from the anode except for a portion of the anode located at or adjacent an end of the layer remote from the medium. Thus the mesh anode along the whole length is omitted but there may be provided a small length of anode material at the top. This may be just inside the layer or at the top but preferably is just outside the top of the layer. The additional anode material can increase the height of corrosion protection above the water line and can cause an ionic reaction at the steel which consumes oxygen in the column at the top of the layer or jacket. The consumption of the oxygen at this location prevents, or at least inhibits, the oxygen from permeating downwardly in the column to the steel in the high corrosion zone within the jacket. This inhibition of the penetration of the oxygen operates in conjunction with the impervious nature of the jacket and the sealed attachment of the jacket around the column as a continuous sealed sleeve.

Thus the anode at the end of the layer acts to cause an ionic reaction at the steel which consumes oxygen from the concrete to reduce availability of oxygen through the concrete at the end of the layer.

Preferably the anode at the end of the layer is formed by one or more anode bodies buried in the concrete just beyond the end of the layer.

Preferably the impermeable layer covers a cementitious layer of grout covered over a surface of the concrete and preferably the impervious layer includes generally ring shaped or annular sealing member surrounding the column at the top of the impervious layer. The sealing ring may include an inner edge portion which extends into the outer surface of the concrete to inhibit penetration of oxygen into the concrete at the upper end of the layer. Where an outer grout layer is used, the sealing member extends from the layer at the outside surface of the grout to the outer surface of the concrete or into the concrete.

As an alternative, the impervious layer can be applied directly to an outer surface of the concrete.

The anode in the medium comprises at least one anode body which may be a single such anode body or may be more than one as required. The anode body or bodies may be attached to an exterior surface of the concrete at a position thereon beyond the end of the layer. Alternatively the anode body may be located at any other suitable position within the medium. Where the medium is sea water, the anode body may be suspended within the sea water adjacent the column or may be located on or buried in the sea floor.

Preferably the anode is formed of a sacrificial material such that the current is generated by galvanic action. However the arrangement of the present invention can also be used with impressed current systems where a generator applies a DC voltage across the anode and the steel to protect the steel without causing sacrificial breakdown of the anode material.

The structure which can be protected using this technique is in many cases a column where the jacket can surround the column and act to exclude the oxygen and to enhance wetting throughout the whole structure. However other structures can be protected including larger elements such as an end support wall of a bridge. In this case the wall cannot practically be surrounded but the impermeable layer can be applied over a single surface of the wall with advantageous results.

The medium within which the structure is located is commonly sea water or water in contact with the sea since this medium is particularly problematic. However this is not a limitation of the present invention and the techniques described and claimed herein can advantageously be used in other locations where the problem exists. The structure may be directly in contact with water such as where a column is located in the sea water, or the structure may merely be located in a soil or other medium which tends to be heavily wetted so that there is sufficient moisture present to generate the corrosion problem required to be overcome.

According to a second aspect of the invention there is provided a method of cathodic protection of a concrete column comprising:

wherein a first part of the concrete column is in contact with salt water and a second part of the column, continuous with the first, is spaced from the salt water and exposed to air;

the concrete column having steel reinforcement in the first part and the second part;

applying to the column a covering layer which surrounds a part of the length of the column, the layer extending from the first part of the column which is generally in the salt water to the second part of the column so as to have a portion of the layer which is generally in contact with the salt water and a portion of the layer which is generally out of contact with the salt water;

inhibiting passage of oxygen from the air to the concrete covered by the layer by forming the layer from an oxygen impermeable material and by attaching the layer such that the layer forms a sealed sleeve surrounding the column;

inhibiting passage of moisture to the air from the concrete covered by the layer by forming the layer from a moisture impermeable material and by attaching the layer such that the layer forms a sealed sleeve surrounding the column, such that the concrete in the second part of the column covered by the layer is maintained wetted by the salt water;

providing an anode in the salt water;

providing an electrical connection from the anode in the salt water to the steel in the concrete;

arranging the anode such that a current flows through the electrical connection between the anode and the steel and an ionic current flows through the salt water and the concrete between the anode and the steel tending to inhibit corrosion of the steel;

the anode being arranged such that no part of the anode is located under the layer.

According to a third aspect of the invention there is provided a method of cathodic protection of a concrete column comprising:

wherein a first part of the concrete column is in contact with salt water and a second part of the column, continuous with the first, is spaced from the salt water and exposed to air;

the concrete column having steel reinforcement in the first part and the second part;

applying to the column a covering layer which surrounds a part of the length of the column, the layer extending from the first part of the column which is generally in the salt water to the second part of the column so as to have a portion of the layer which is generally in contact with the salt water and a portion of the layer which is generally out of contact with the salt water;

inhibiting passage of oxygen from the air to the concrete covered by the layer by forming the layer from an oxygen impermeable material and by attaching the layer such that the layer forms a sealed sleeve surrounding the column;

inhibiting passage of moisture to the air from the concrete covered by the layer by forming the layer from a moisture impermeable material and by attaching the layer such that the layer forms a sealed sleeve surrounding the column, such that the concrete in the second part of the column covered by the layer is maintained wetted by the salt water, providing an anode in the salt water;

providing electrical connection from the anode in the salt water to the steel in the concrete;

arranging the anode such that a current flows through the electrical connection between the anode and the steel and an ionic current flows through the salt water and the concrete between the anode and the steel tending to inhibit corrosion of the steel;

the anode being defined solely by at least one anode body in the salt water and at least one anode body in the concrete at or adjacent a top of the layer.

According to a fourth aspect of the invention there is provided a method of cathodic protection comprising:

providing a concrete column;

wherein a first part of the concrete column is in contact with salt water and a second part of the column, continuous with the first, is spaced from the salt water and exposed to air;

the concrete column having steel reinforcement in the first part and the second part;

applying to the column a cementitious covering layer of a cementitious grout which surrounds a part of the length of the column, the cementitious covering layer being surrounded by an impervious covering layer formed of an air and water impervious material forming an air and water impervious sleeve, the cementitious covering layer and the sleeve extending from the first part of the column which is generally in the salt water to the second part of the column so as to have a portion of the sleeve which is generally in contact with the salt water and a portion of the sleeve which is generally out of contact with the salt water;

providing an anode in the salt water;

providing an electrical connection from the anode in the salt water to the steel in the concrete;

arranging the anode such that a current flows through the electrical connection between the anode and the steel and an ionic current flows through the salt water and the concrete between the anode and the steel tending to inhibit corrosion of the steel;

the anode being arranged such that no part of the anode is located under the layer within the salt water and no part of the anode is located under at least a portion of the layer extending from the salt water out of the medium into the second part of the structure;

and sealing a top ring of the cementitious covering layer which extends from the sleeve to the column.

BRIEF DESCRIPTION OF THE DRAWINGS

One embodiment of the invention will now be described in conjunction with the accompanying drawings in which.

DETAILED DESCRIPTION

Figure 1:
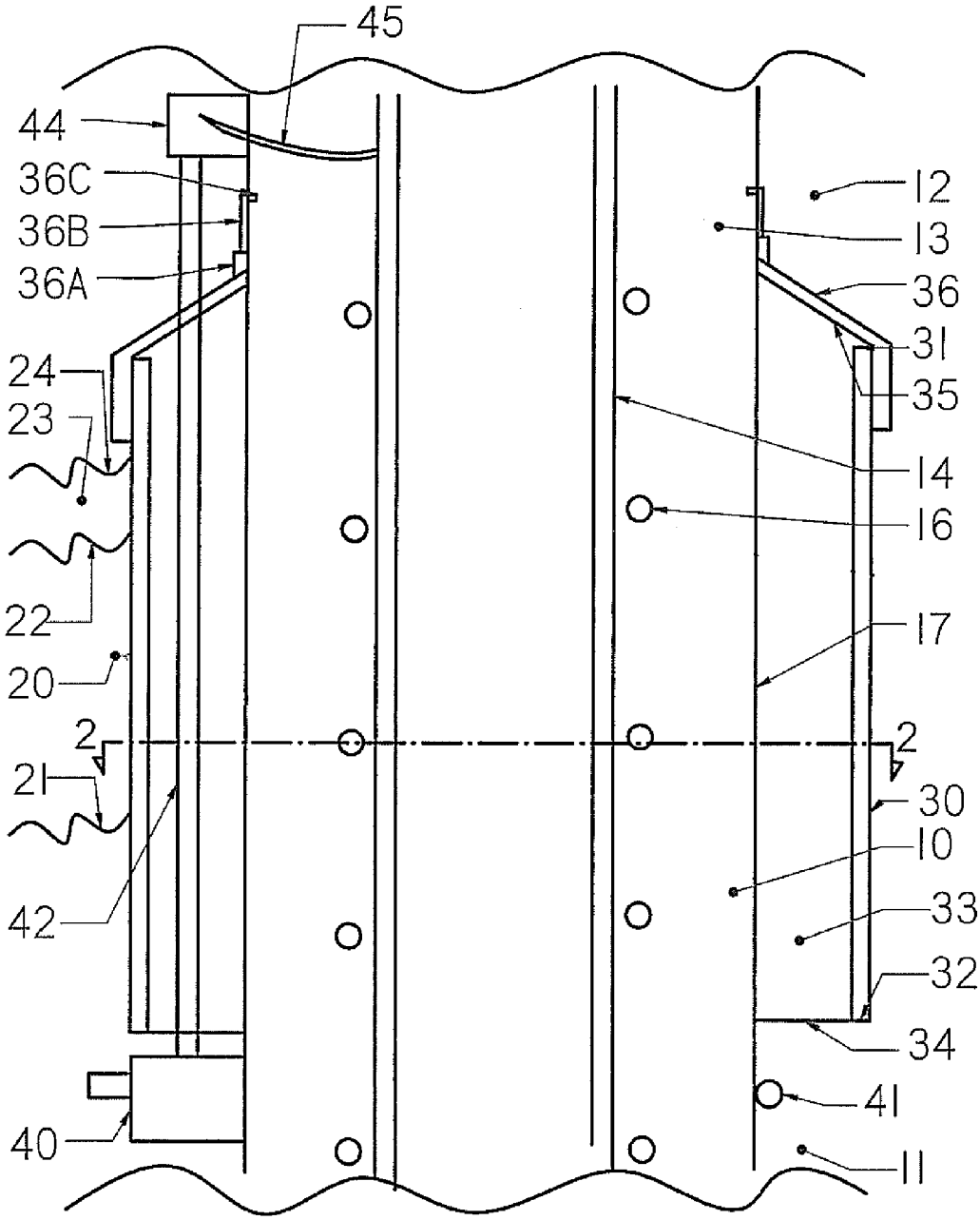
FIG. 1 is a longitudinal cross sectional view through a column including the application to the column of a method of corrosion protection according to the present invention.

In FIG. 1 is shown a conventional reinforced concrete column mounted in water so that the column 10 has a bottom end generally indicated at 11 mounted on a suitable support in the water with the upper end 12 arranged to carry a structure to be supported by the column. Typical columns of this type are formed of a concrete body 13 within which is cast steel reinforcing members generally indicated at 14. These include vertical longitudinal members 14 and transverse or peripheral hoops or ties 16. The steel reinforcement is located inside the column just under the outside surface 17 of the column.

The column is illustrated as being mounted so that a part of the length of the column is located in the inter-tidal zone generally indicated at 20 with a low tide mark indicated at 21 and a high tide mark indicated at 22. Above the high tide mark is a splash zone 23 with an upper location 24. It will of course be appreciated that the tides vary and the amount of splash height varies but in general the area between the low tide mark 21 and the top of the splash zone 24 provides an area of the column which is subject to repeated wetting and drying depending upon the height of the water surrounding the column at any time.

This zone of the concrete column is particularly subject to corrosion since the steel is exposed to moisture, chlorides and oxygen which act to break down the steel and form corrosion products. These corrosion products may cause expansion sufficient to crack of the concrete. In addition to this cracking, the corrosion of the steel may also result in loss of structural capacity.

The technique of the present invention is commonly used as a repair technique for the column but it can also be used in new constructions.

Figure 2:
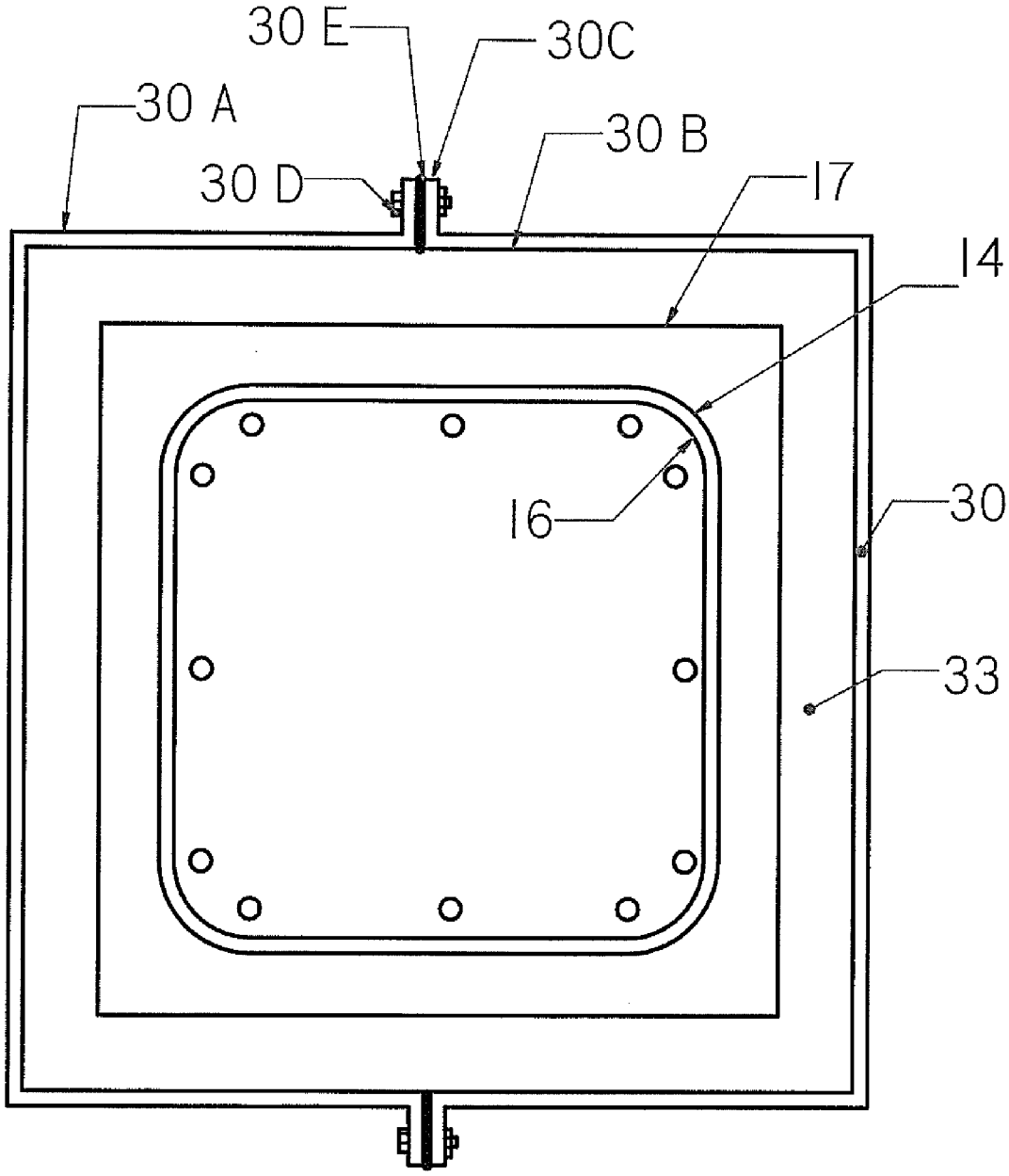
FIG. 2 is a cross section along the lines 2-2 of FIG. 1.

The construction of the present method comprises a surrounding impermeable layer or jacket 30 which is attached to the column at a position outward of the outer surface 17 of the column. The jacket 30 is formed of an impermeable material such as resin. The jacket may be reinforced to provide structural strength to assist resisting movement of the concrete or the jacket may be stretchable or flexible without such reinforcement so that it simply moves with any movement of the concrete. Where reinforced, it may be reinforced by fibres such as glass, plastics, carbon fibers or other materials well known to a person skilled in the art. In the embodiment as shown in FIG. 2, the impermeable layer or jacket 30 is formed in pieces 30A and 30B which are connected at a joint 30C. In the embodiment shown the joint is a butting flange joint where two projecting flanges of the two parts of the jacket butt and are clamped together by screws 30D with a layer of a sealing material 30E between the two butting flanges. This ensures that the jacket is fully sealed around the column at the connections between the parts of the jacket to form a sealed sleeve around the column from a top edge 31 of the jacket to a bottom edge 32 of the jacket.

Inside the jacket is filled with a cementitious or polymer grout or other filler material 33 to form a band of the material around the column within the jacket. In most cases the jacket is used as a form for applying the grout to the column. Prior to application, repairs can be made to any cracked portions by excavation or removal of damaged concrete materials so that the finished jacket is filled with material surrounding the column and filling any indentations, cracks or excavated portions of the concrete column. The grout is commonly Portland cement based which cures and bonds to the outside surface of the column and acts as an effective filler. Other types of filler materials including epoxy grout, polymer grout, vinyl ester grout and other organic and inorganic based materials may be used.

During filling of the jacket, a bottom edge of the jacket may be closed by a forming structure to hold the grout material in place until it is set. After the setting of the grout, the bottom form is preferably removed so that the bottom surface 34 of the grout is exposed. However it may also be left in place.

At the top of the jacket, after filling, an upper surface 35 of the grout is exposed and may be shaped as shown at an inclined surface to provide a shedding action. In this arrangement, however, an additional sealing member 36 is preferably applied over the surface 35 to connect to the upper edge 31 of the jacket so that the upper part of the grout is sealed down to the surface 17 of the concrete column.

In this embodiment, there is no sacrificial anode material or any other part of the anode structure of the cathodic protection system which is located underneath the jacket 30.

The anode for the cathodic protection system is thus provided solely as a bulk anode 40 attached onto the outside surface 17 of the column at a position below the bottom edge of the jacket. In the arrangement shown the bulk anode 40 is attached in place by a suitable clamping systematically indicated at 41. However other mounting locations and mounting techniques can be used where the anode may be installed at a position spaced from the column. The bulk anode is connected to the reinforcing steel by an electrical conductor or wire 42. The wire 42 preferably extends preferably through the inside surface of the jacket and through the grout 33 to a junction box 44 above the top edge 31 of the jacket. The junction box 44 when attached onto the outside of the column allows ready access to the wiring for later repair or analysis. The wire 42 within the junction box 44 connects to an electrical wire 45 which is connected to the steel reinforcement within the column. If necessary, additional connections can be provided to other parts of the steel depending upon the electrical continuity of the steel reinforcement bars.

Thus the cathodic protection system includes an anode provided by the sacrificial anode material, a cathode provided by the reinforcing steel an electrical connection from the anode to the steel and an ionic connection from the anode through the medium of the salt water, through the concrete to the steel to provide cathodic protection of the steel while effecting sacrificial corrosion of the anode. The system thus includes an anode which may be formed as a single anode body or may include a plurality of separate anode members. In the embodiment of FIG. 1 there is a single anode member formed by the bulk anode 40.

Without being bound to a particular theory, it is believed that the cathodic protection system causes protection of the steel elements within the jacket in that firstly the formation of the impermeable sleeve around the steel within the jacket prevents escape of moisture from the jacket during the time that the concrete is exposed to the air and thus is otherwise free to dry. The presence of the jacket and the optional sealing member thus acts to carry moisture upwardly within the concrete and, depending on the permeability of the grout, within the grout inside the jacket so the moisture is carried up to the top of the jacket thus maintaining the concrete and, in some cases, the grout within the jacket, to a higher level of moisture than would normally be expected. This high level of moisture within the jacket allows communication of ionic current from the anode through the concrete to the steel within the jacket. Even though a large portion of the current is carried through the sea water to the steel under the sea water, a sufficient proportion of the current passes to the steel under the jacket in order to maintain cathodic protection of the steel and thus inhibit corrosion to an extent which is sufficient for the circumstances.

At the same time the presence of the jacket and the optional presence of the sealing member 36 reduces the penetration of oxygen into the concrete. The reduction in the amount of oxygen permeating to the steel thus contributes to the corrosion protection of the steel under the jacket and reduces the level of the current required to maintain cathodic protection.

The present inventor has realized that the arrangement as described above, in which there is provided a bulk anode outside of the jacket is sufficient to provide cathodic protection to the steel within the jacket without the necessity for an anode in the concrete within the jacket.

The jacket is preferably located so that its bottom end is below the waterline. However it will be appreciated that the water line varies and it is intended that the lower end be in the water most of the time and is of course not essential that the waterline never fall below the lower end of the jacket. Thus it is suitable if the concrete remains generally wetted that the interior of the concrete remains wet, that is, there are pores or interior locations which remain saturated.

It will be noted therefore that the whole of the jacket is free from any part of the anode of the system. The whole of the anode for the system is provided by the bulk anode 40. In the area under the jacket there is no anode material. Protection of the steel within the inter-tidal zone and within the splash zone of the concrete as covered by the jacket is thus obtained simply by using the presence of the bulk anode 40 and by encasing the portion of the concrete within that area by the sealed jacket which is impermeable to oxygen into the concrete and impermeable to the escape of moisture from the concrete.

In FIG. 1, the optional sealing member 36 is formed with a depending ring 36A which extends around the outside of the upper edge of the jacket and provides a seal therewith. The sealing effect of the depending ring can be enhanced by the presence of an adhesive or sealant of a suitable nature as will be well known to one skilled in the art. The inclined annular sealing member 36 can include an upper ring or vertical cylinder 36B surrounding the column or it may include an edge piece 36C which extends horizontally into the concrete of the column.

Figure 3:
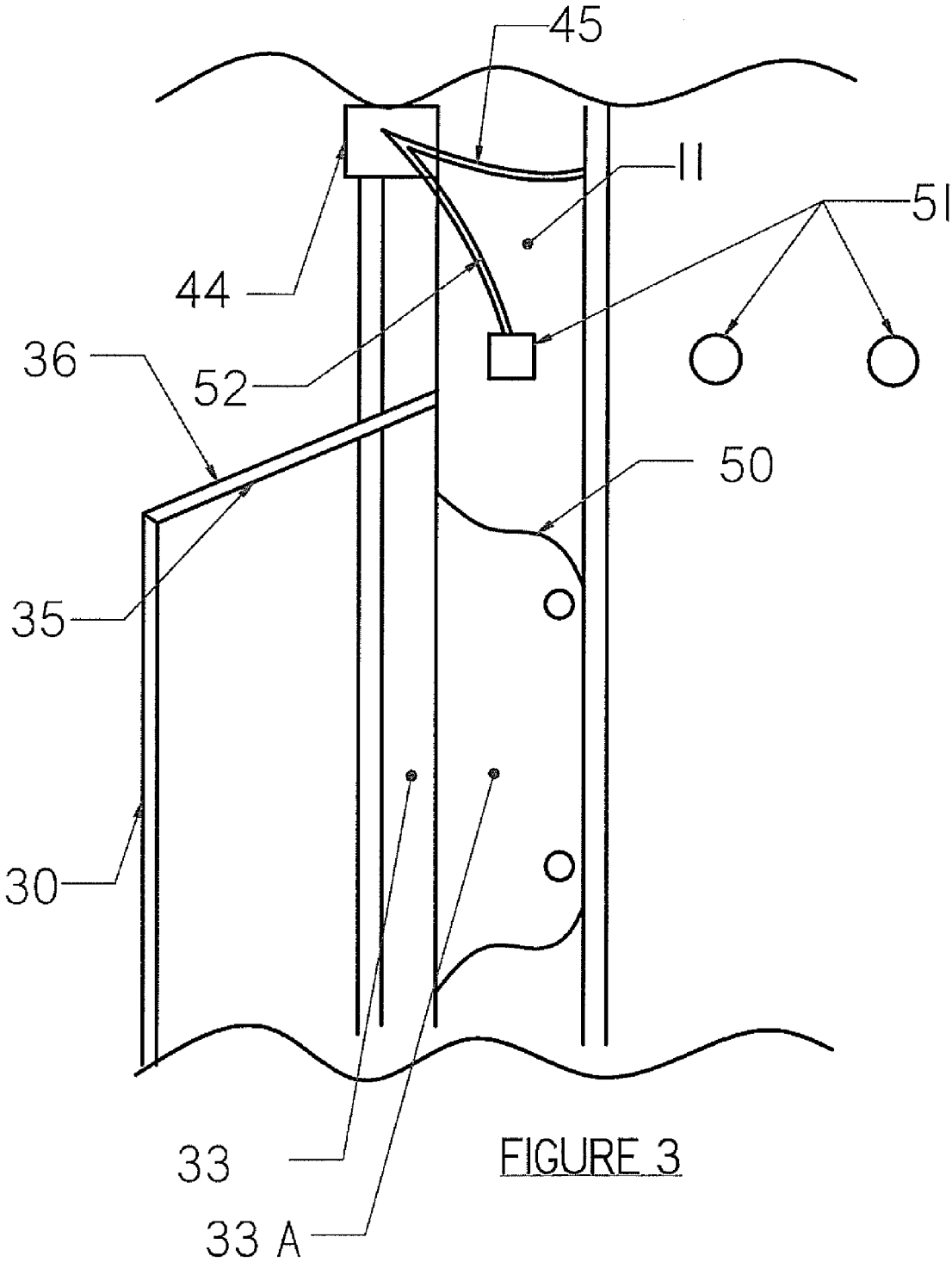
FIG. 3 is a similar longitudinal cross section of FIG. 1 showing a modified method and showing only the upper part of the column on an enlarged scale.

Turning now to FIG. 3, an alternative arrangement is shown utilizes the concept shown in FIGS. 1 and 2. Thus there is provided a jacket 30 and a sealing member 36. In this embodiment the sealing member is provided not by a structural member of simple plastics material shaped to engage over and around the column but is instead provided by a coating applied onto the exposed portion of the surface 35 of the grout. Suitable coatings are available as will be well known to one skilled in the art which can be applied onto the exposed portion of the grout to provide the sealing action.

In this figure also is shown in the covering of an excavation 50 within the concrete of the column 11 so that the excavation 50 exposes some parts of the steel and is filled by the grout 33 at a portion indicated at 33A.

In this embodiment also is shown the addition of a plurality of separate anode bodies indicated at 51 which are embedded within the column in the vicinity of the sealing member which may be just above or just below the sealing member 36. The anode bodies can be of the type described in prior U.S. Pat. Nos. 6,165,346 and 6,572,760 of the present inventor the disclosures of which are incorporated herein by reference. The anodes are inserted by drilling a hole in the concrete of the column and by inserting a cylindrical anode body into that hole. Preferably there is provided in a series of anode members at spaced positions around the periphery of the column and each of these is connected directly to the reinforcing steel or more preferably to a separate lead or connection 52 communicating to the junction box 44. As previously described, the connection from the junction box 44 is connected through a connection line 45 to the steel at a suitable location. In this way the anode for the system is provided not only by the bulk anode at the bottom of the column within the seal water but by additional anode members 51 at or adjacent the top of the jacket.

As these anode bodies 51 are located above the splash zone they tend to be separated from the wetted concrete and thus located generally in dry concrete which has reduced galvanic action on the anode.

The anode bodies 51, therefore may carry enhancement material as described in the above patent.

The level of the pH and the presence of the humectant enhances the maintenance of the current so that the current can be maintained for an extended period of time in a range 5 to 20 years.

In addition to the above materials, there is also applied into the mortar material, or into the anode body itself a humectant or deliquescent material. Suitable materials include $Ca(NO3)2$, $CaCl2$, $LiNO3$, $CaNO2$, $MgCl2$, $Na2SO4$ and many others well known to one skilled in the art. Such humectants are basically in solid or powder form but can be dissolved to form an aqueous solution. Alkali material arranged to maintain the pH greater than 12 can also be used. Further details of such materials and the humectants are disclosed in the above patents of the present inventor.

The presence of the humectant material acts to absorb sufficient moisture to maintain conductivity around the anode to ensure that sufficient output current is maintained during the life of the anode and to keep the anode/filler interface electrochemically active. The presence also increases the amount of the current. Even though the mortar material 21 is not exposed to the atmosphere as it is buried within the concrete, and even though the humectant material is bound in fixed form into the mortar material, it has been found that absorption of moisture into the humectant material is sufficient to enhance the maintenance of the current output and to prevent premature reduction of output current over an extended period of operation and before the anode is consumed.

The bulk anode 40 generally does not provide or require such enhancement materials since it is located in the aggressive action provided by the sea water both in view of the high conduction through the sea water and the chlorides which are present. However such enhancement materials can be provided if required.

The anode members 51 located at or adjacent or slightly above the sealing member 36 at the top of the jacket have potentially two effects. Firstly they provide a small addition to the galvanic action to the steel adjacent the top of the jacket to carry the galvanic action to a position higher within the jacket to provide additional protection to the top of the jacket. However and more importantly the anode members at the top of the structure are believed to provide an ionic action in the steel at the top of the jacket which acts to consume oxygen which permeates into the concrete in the area around the column at the top of the jacket so as to further reduce the level of oxygen inside the jacketed portion of the column.

In this way the corrosion protection of the steel within the jacket is provided to a level sufficient for satisfactory cathodic protection of the steel even though the protection is provided simply by the bulk anode within this sea water at the bottom of the jacket.

This arrangement has the advantage that there is no necessity to manufacture the complex jacket and anode combination described for example in the above published PCT application of the present applicant or in the above Altrista patent. The present invention therefore provides a lower cost alternative by which cathodic protection to the steel in the splash zone can be provided by using only the simple bulk anode together with a more simple construction of jacket which can be manufactured locally simply by the formation of a plastic shell or fiber glass shell shaped to wrap around the column.

The flange-type connection of the arrangement of FIG. 2 can be replaced by a simple overlapping seal between the two parts of the jacket or by a tongue and groove seal. However it is necessary to ensure that a sealing action is provided between the overlapping parts of the jacket preferably by the introduction of a sealing material between the two parts of the structure before a bolting or clamping action is effected to hold the two parts together.

As a further alternative, the jacket can be formed as a single part which is wrapped around the column and a single overlap seal can be provided.

Figure 4:
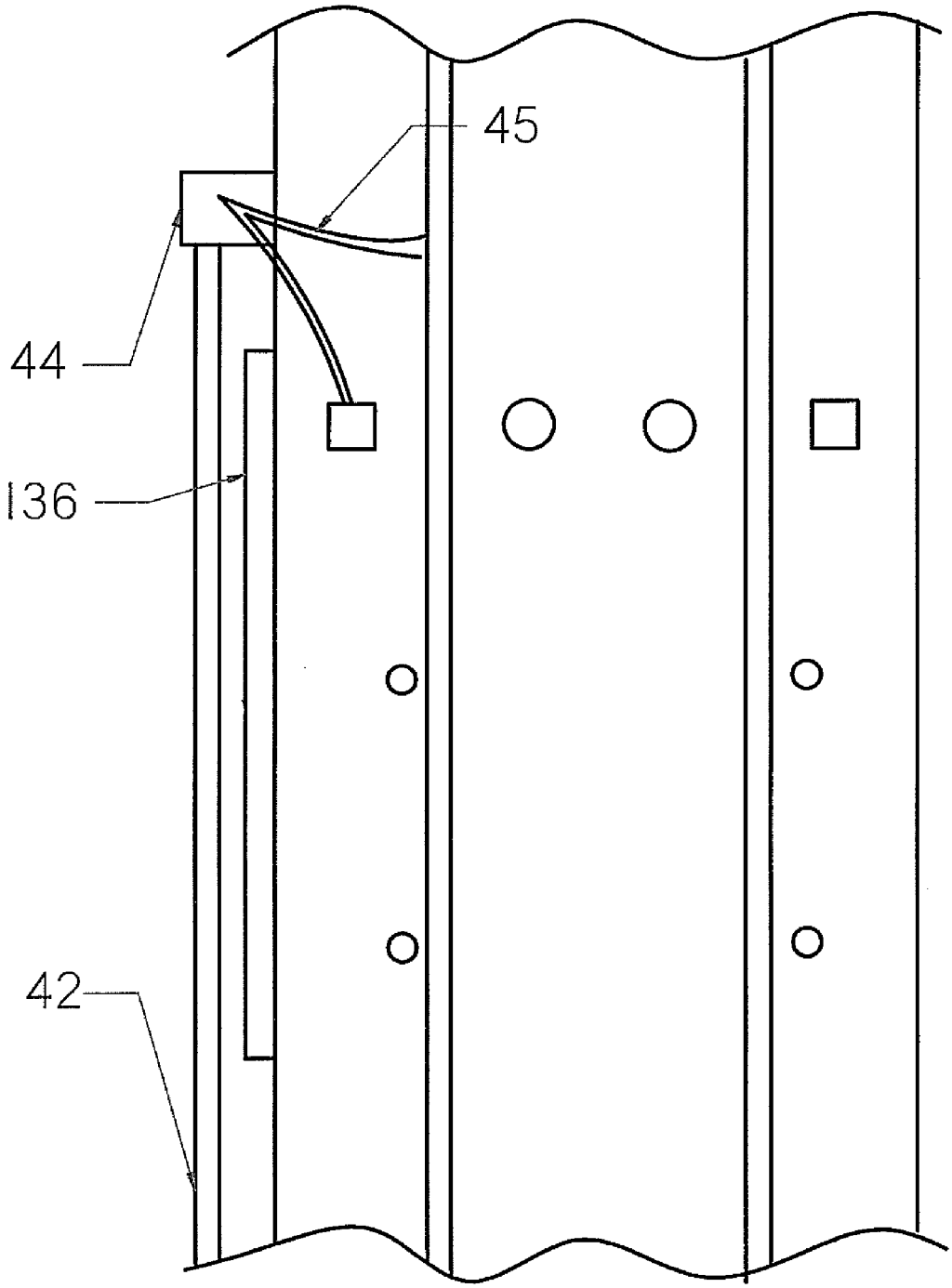
FIG. 4 is a similar longitudinal cross sectional view showing a further modified method.

In FIG. 4 is shown a further alternative arrangement in which the jacket 36 is replaced by a jacket 136 which is wrapped around the column and applied directly to the outside surface of the concrete In this arrangement, therefore, there is provided no additional grout apart from possibly grout provided to fill cracks or holes within the concrete of the column. The intention is therefore that a simple sleeve is wrapped around the column in the inter-tidal and splash zone. If there is no necessity for repair, the jacket 136 is applied directly onto the column without any grout at all. In this arrangement the jacket can be provided by a fibreglass lay-up process formed on site simply by applying or wrapping fiber glass sheet material and a resin onto the outside surface of the column. Other suitable plastic, rubber, organic or inorganic materials can be used as the sheet. Below the wrapped jacket or applied layer is applied the bulk anode as previously described. The anode connection 45 and the optional junction box 44 may be located above the jacket as shown in FIG. 1. In this embodiment the connecting lead 42 can simply be passed around the outside of the jacket and held in place on the column by suitable fasteners. This arrangement therefore provides a very simple construction formed on site at relatively low cost by providing simply the wrapping 136 forming the jacket and the bulk anode together with the connection or Junction box 44.

Figure 5:
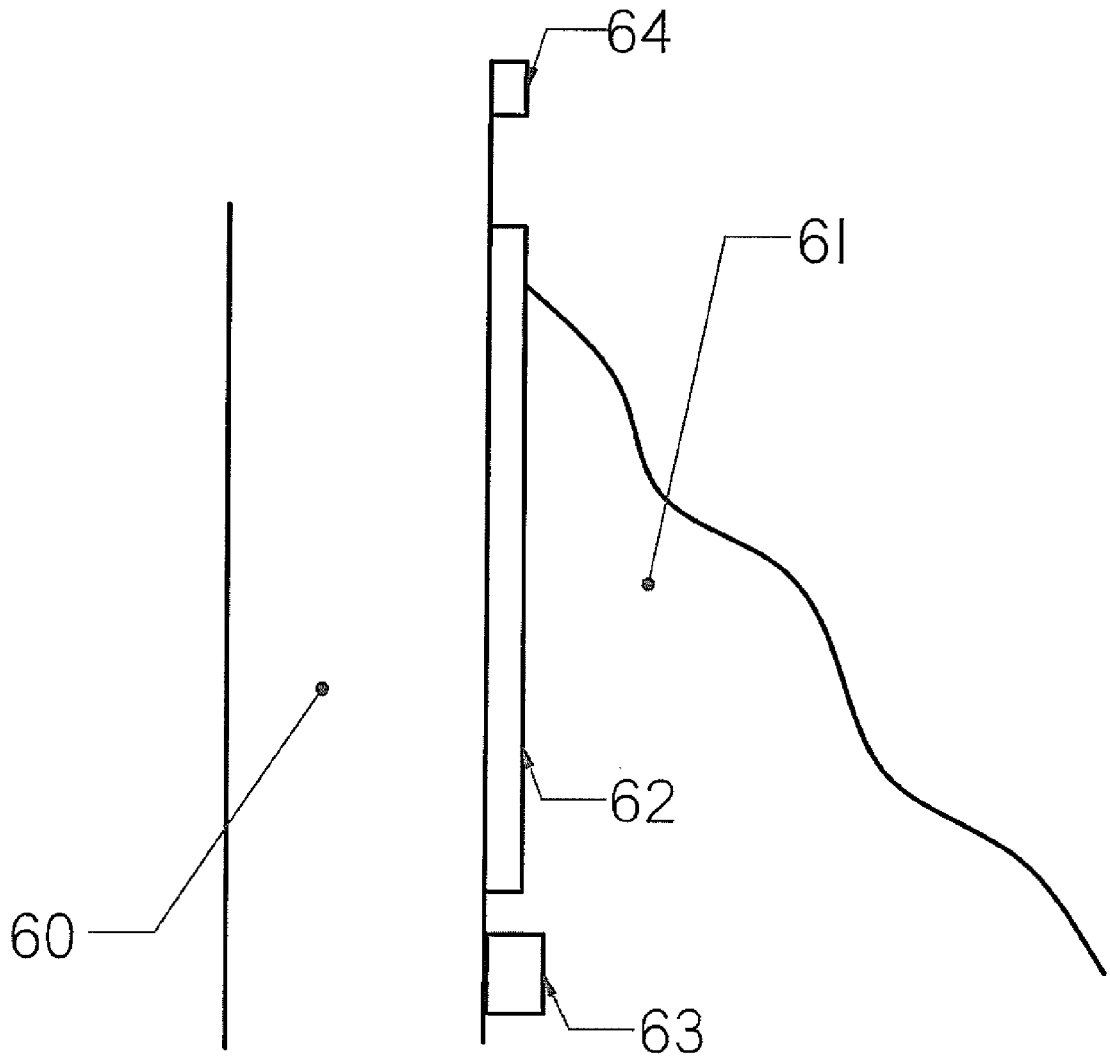
FIG. 5 is a vertical cross sectional view through a concrete wall using the method of the present invention in a modified arrangement.

In FIG. 5 is shown the application of the above techniques to an upstanding wall 60 which acts to brace fill material 61 on one side of wall, for example in a bridge structure where the wall forms a support for the end of the bridge beams. The wall therefore may have a width equal to the width of the bridge. The medium 61 can simply be wet soil or it may be that the wall is formed also in sea water which therefore contacts both surfaces of the wall. However in this arrangement a layer 62 is applied onto one surface of the wall in the manner as described above in relation to FIG. 1 or FIG. 4 so the bulk anode 63 is provided in the medium and is connected to the reinforcing steel. The connection may be provided at a junction box 64 above the layer if monitoring is required. However the more simple arrangement of the direct connection without the necessity of a junction box can also be used. In this arrangement, therefore, the layer does not form a jacket surrounding the structure but instead is applied on one side. However this same effect occurs in that the application of the layer onto the concrete reduces the penetration of oxygen into the concrete and reduces the escape of moisture from the concrete so as to provide the dual effect of providing increased ionic current and reduced oxygen availability to improve the corrosion protection of the steel underneath the layer and/or to reduce the current requirement to provide adequate protection for the steel.

In some cases the layer 62 is provided on only one surface of the structure and other embodiments may be provided on both surfaces of the structure, depending upon the location of the medium 61 and the presence of the corrosion problem.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of cathodic protection of a concrete structure comprising:

wherein a first part of the concrete structure is in contact with a medium, which contains water and is ionically conductive, and a second part of the concrete structure, continuous with the first part, is spaced from the medium and exposed to air;

the concrete structure having steel reinforcement in the first part and the second part;

applying to the structure a covering layer which covers at least part of at least one surface of the structure, the layer extending from the first part of the structure to the second part of the structure so as to have a portion of the layer which is generally in contact with the moisture and a portion of the layer which is generally out of contact with the moisture;

inhibiting passage of oxygen from the air to the concrete covered by the layer by forming the layer from an oxygen impermeable material and by attaching the layer such that the layer is sealed relative to the concrete;

inhibiting passage of moisture to the air from the concrete covered by the layer by forming the layer from a moisture impermeable material and by attaching the layer such that the layer is sealed relative to the concrete, such that the concrete in the second part of the structure covered by the layer is maintained wetted by the moisture;

providing an anode in the medium;

providing an electrical connection from the anode in the medium to the steel in the concrete;

arranging the anode such that a current flows through the electrical connection between the anode and the steel and an ionic current flows through the medium and the concrete between the anode and the steel tending to inhibit corrosion of the steel;

the anode being arranged such that no part of the anode is located under that part of the layer which is generally within the medium and no part of the anode is located under at least a portion of the layer extending from the medium which is generally out of the medium into the second part of the structure;

and inhibiting corrosion in the steel in the second part of the structure lying under the layer by the anode in the medium.

2. The method according to claim 1 including inhibiting corrosion in the steel in the second part of the structure lying under the layer by current passing through the concrete under the layer which is maintained wetted by the layer.

3. The method according to claim 1 including inhibiting corrosion in the steel in the second part of the structure lying under the layer by a reduction in the level of oxygen in the concrete under the layer.

4. The method according to claim 1 wherein the whole of the layer is arranged such that no part of the anode is located under the layer.

5. The method according to claim 1 wherein the layer is free from the anode except for a portion of the anode located at or adjacent an end of the layer remote from the medium.

6. The method according to claim 5 wherein the portion of the anode at the end of the layer acts to cause a reaction at the steel which consumes oxygen from the concrete to reduce oxygen levels in the concrete under the layer.

7. The method according to claim 6 wherein the portion of the anode at the end of the layer is formed by one or more anode bodies buried in the concrete just beyond the end of the layer.

8. The method according to claim 1 wherein the layer covers a layer of grout covered over a surface of the concrete.

9. The method according to claim 8 wherein the layer includes a sealing member extending from an outside surface of the grout to the concrete.

10. The method according to claim 1 wherein the layer is applied directly to an outer surface of the concrete.

11. The method according to claim 1 wherein the anode in the medium comprises at least one anode body attached to an exterior surface of the concrete at a position thereon beyond the end of the layer.

12. The method according to claim 1 wherein the anode is formed of a sacrificial material such that the current is generated by galvanic action.

13. The method according to claim 1 wherein the covering layer contains reinforcing fibers.

14. The method according to claim 1 wherein the covering layer is resilient so as to move with the concrete.

15. The method according to claim 1 wherein the covering layer cooperates with the steel reinforcement to provide structural strength for the concrete.

16. A method of cathodic protection of a concrete column comprising, wherein a first part of the concrete column is in contact with salt water and a second part of the column, continuous with the first, is spaced from the salt water and exposed to air;

the concrete column having steel reinforcement in the first part and the second part;

applying to the column a covering layer which surrounds a part of the length of the column, the layer extending from the first part of the column which is generally in the salt water to the second part of the column so as to have a portion of the layer which is generally in contact with the salt water and a portion of the layer which is generally out of contact with the salt water;

inhibiting passage of oxygen from the air to the concrete covered by the layer by forming the layer from an oxygen impermeable material and by attaching the layer such that the layer forms a sealed sleeve surrounding the column;

inhibiting passage of moisture to the air from the concrete covered by the layer by forming the layer from a moisture impermeable material and by attaching the layer such that the layer forms a sealed sleeve surrounding the column, such that the concrete in the second part of the column covered by the layer is maintained wetted by the salt water;

providing an anode in the salt water;

providing an electrical connection from the anode in the salt water to the steel in the concrete;

arranging the anode such that a current flows through the electrical connection between the anode and the steel and an ionic current flows through the salt water and the concrete between the anode and the steel tending to inhibit corrosion of the steel;

the anode being arranged such that no part of the anode is located under the layer.

17. The method according to claim 16 wherein the steel in the second part of the column lying under the layer has corrosion therein inhibited by ionic current from the anode in the salt water, with current passing through the concrete which is maintained wetted by the layer.

18. The method according to claim 16 wherein the steel in the second part of the column lying under the layer has corrosion therein inhibited by a reduction in the level of oxygen in the concrete under the layer.

19. The method according to claim 16 wherein the impermeable layer covers a surrounding coating of grout surrounding the column.

20. The method according to claim 19 wherein the layer includes a sealing member extending from an outside surface of the grout to the concrete.

21. The method according to claim 16 wherein the layer is applied directly to an outer surface of the column.

22. The method according to claim 16 wherein the anode in the salt water comprises at least one anode body attached to an exterior surface of the column at a position thereon beyond the end of the layer within the salt water.

23. The method according to claim 16 wherein the anode is formed of a sacrificial material such that the current is generated by galvanic action.

24. The method according to claim 16 wherein the covering layer contains reinforcing fibers.

25. The method according to claim 16 wherein the covering layer is resilient so as to move with the concrete.

26. The method according to claim 16 wherein the covering layer cooperates with the steel reinforcement to provide structural strength for the concrete.

27. A method of cathodic protection of a concrete column comprising:

wherein a first part of the concrete column is in contact with salt water and a second part of the column, continuous with the first, is spaced from the salt water and exposed to air;

the concrete column having steel reinforcement in the first part and the second part;

applying to the column a covering layer which surrounds a part of the length of the column, the layer extending from the first part of the column which is generally in the salt water to the second part of the column so as to have a portion of the layer which is generally in contact with the salt water and a portion of the layer which is generally out of contact with the salt water;

inhibiting passage of oxygen from the air to the concrete covered by the layer by forming the layer from an oxygen impermeable material and by attaching the layer such that the layer forms a sealed sleeve surrounding the column;

inhibiting passage of moisture to the air from the concrete covered by the layer by forming the layer from a moisture impermeable material and by attaching the layer such that the layer forms a sealed sleeve surrounding the column, such that the concrete in the second part of the column covered by the layer is maintained wetted by the salt water;

providing an anode in the salt water;

providing electrical connection from the anode in the salt water to the steel in the concrete;

arranging the anode such that a current flows through the electrical connection between the anode and the steel and an ionic current flows through the salt water and the concrete between the anode and the steel tending to inhibit corrosion of the steel;

the anode being defined solely by at least one anode body in the salt water below the layer and at least one anode body in the concrete at or adjacent a top of the layer,

28. A method of cathodic protection of a concrete column comprising:

wherein a first part of the concrete column is in contact with salt water and a second part of the column, continuous with the first, is spaced from the salt water and exposed to air;

the concrete column having steel reinforcement in the first part and the second part;

applying to the column a cementitious covering layer of a cementitious grout which surrounds a part of the length of the column, the cementitious covering layer being surrounded by an impervious covering layer formed of an air and water impervious material forming an air and water impervious sleeve, the cementitious covering layer and the sleeve extending from the first part of the column which is generally in the salt water to the second part of the column so as to have a portion of the sleeve which is generally in contact with the salt water and a portion of the sleeve which is generally out of contact with the salt water;

providing an anode in the salt water;

providing an electrical connection from the anode in the salt water to the steel in the concrete;

arranging the anode such that a current flows through the electrical connection between the anode and the steel and an ionic current flows through the salt water and the concrete between the anode and the steel tending to inhibit corrosion of the steel;

the anode being arranged such that no part of the anode is located under the layer within the salt water and no part of the anode is located under at least a portion of the layer extending from the salt water out of the medium into the second part of the structure;

and sealing a top ring of the cementitious covering layer which extends from the sleeve to the column.

* * * * *